US005085003A

United States Patent [19]

Garcia

[11] Patent Number: 5,085,003

[45] Date of Patent: Feb. 4, 1992

[54] PLANT COVER/WRAP SYSTEM

[75] Inventor: Pedro F. Garcia, Atlanta, Ga.

[73] Assignee: Highland Supply Corporation, Highland, Ill.

[21] Appl. No.: 434,584

[22] Filed: Nov. 13, 1989

Related U.S. Application Data

[63] Continuation of Ser. No. 149,002, Jan. 27, 1988, abandoned.

[51] Int. Cl.[5] ..... A01G 9/02

[52] U.S. Cl. ..... 47/72; 47/84

[58] Field of Search ..... 206/45.31; 47/66, 72, 47/84, 41

[56] References Cited

U.S. PATENT DOCUMENTS

| | | | |
|---|---|---|---|
| 1,421,628 | 7/1922 | Watkins . | |
| 1,693,435 | 11/1928 | Clarke | 206/45.31 |
| 1,951,642 | 3/1934 | Augustin et al. | 47/66 |
| 2,317,554 | 4/1943 | Risch | 206/45.31 |
| 2,355,559 | 8/1944 | Renner | 47/72 |
| 3,869,828 | 3/1975 | Matsumoto | 47/84 |
| 3,962,503 | 6/2977 | Crawford | 47/72 X |
| 4,118,890 | 10/1978 | Shore | 47/84 X |
| 4,216,620 | 8/1980 | Weder et al. | 47/72 |
| 4,300,312 | 11/1981 | Weder et al. | 47/72 |
| 4,621,733 | 11/1986 | Harris | 47/41 |
| 4,733,521 | 3/1988 | Weder et al. | 47/72 |

FOREIGN PATENT DOCUMENTS

| | | | |
|---|---|---|---|
| 560532 | 4/1975 | Switzerland | 47/72 |
| 891078 | 3/1962 | United Kingdom | 47/84 |

*Primary Examiner*—Danton D. DeMille

*Attorney, Agent, or Firm*—Dunlap, Codding, Peterson & Lee

[57] ABSTRACT

A cover/wrap system for flower pots and the like allows the use of any sheet material to cover a pot and be held in place by a sleeve. A transparent sleeve can be used, and colored or patterned material will decorate the pot; and, if the material is subject to moisture damage, an inner sleeve acts as a moisture barrier. The sleeve can be set down, the sheet material placed over the sleeve, and the pot simply placed on the sheet material. The pot will sink into the sleeve and will urge the sheet material around the pot, then hold the material in place.

5 Claims, 1 Drawing Sheet

PLANT COVER/WRAP SYSTEM

This application is a continuation of application Ser. No. 149,002, filed Jan. 27, 1988 now abandoned.

INFORMATION DISCLOSURE STATEMENT

It is very common in the florist industry to utilize a relatively plain clay flower pot for potted plants. While the clay pot is functionally well adapted for potted plants, it is not particularly attractive when the potted plant is to be used as an indoor flower. As a result, florists have long attempted to render the clay flower pot more attractive without detracting from the functionallity of the pot. The most commonly used method for improving the appearance of a flower pot is to wrap the pot in a metal foil, and frequently to add ribbons, bows and other decorations.

While there are a few colors of metal foil available, and one can of course utilize different colors of ribbons and bows, the general appearance of the flower pot is substantially the same at all times. Additionally, it will be understood that one must carefully mold the metal foil around the pot to achieve an attractive appearance. If ribbons and the like are to be added, considerable additional time is required because the ribbons must be individually hand tied, and other decorations must be individually added.

SUMMARY OF THE INVENTION

This invention relates generally to flower pot decorations, and is more particularly concerned with a flower pot cover, or wrapping system, and a method for utilizing the cover or wrap.

The present invention provides, in conjunction with the generally conventional flower pot, a decorative sheet material for substantially covering the pot, and a sleeve for urging the sheet material into the proper form and for retaining the sheet material in place.

In one form of the invention, the sheet material may be very light and flexible material that is folded or gathered around the pot and held in place by the sleeve, the gathering of the sheet material creating part of the decorative scheme for the pot. In another form of the invention, the sheet material may be somewhat stiff, and the sheet material may define cut-outs so the sheet material can surround the pot without undue gathering. In this form of the invention, the sheet material itself will provide the decorative appearance of the pot.

Futher embodiments of the invention include the use of a moisture barrier between the flower pot and the sheet material in the event the sheet material is not moisture resistant.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
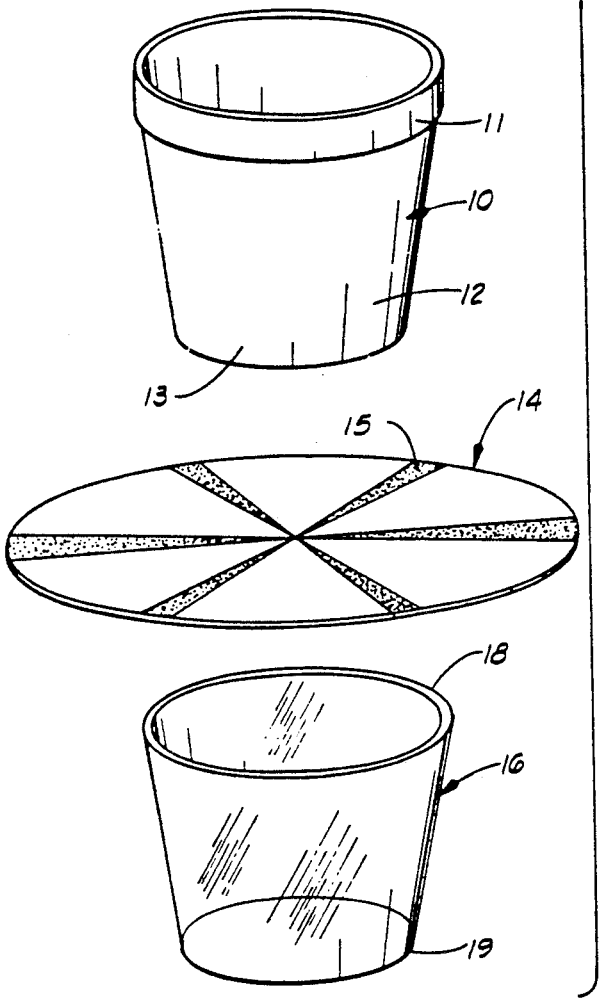
FIG. 1 is an exploded view illustrating the cover/-wrap system of the present invention in conjunction with a generally conventional flower pot.

Referring now more particularly to the drawings, and to those embodiments of the invention here presented by way of illustration, FIG. 1 shows a generally conventional flower pot designated at 10, the flower pot 10 having a thicker rim 11 and a substantially frustoconical body portion 12. Those skilled in the art will understand that flower pots such as the pot 10 are frequently formed of terra cotta or other clay materials, and tend to be not particularly attractive for indoor use. It is therefore pots of this type that are normally covered by metal foil, perhaps with ribbons or the like for decoration.

In accordance with the present invention, a piece of sheet material designated at 14 is utilized to cover the pot 10. As here shown, it is contemplated that the sheet material 14 might be substantially circular, and might include a plurality of stripes or other printed design generally designated at 15. Futhermore, the sheet material 14 will generally be a relatively flimsy material, for example a polyethylene film having a thickness in the vicinity of one mil. Polyethylene is mentioned only by way of example, and it will be readily understood by those skilled in the art that polypropylenes, polyethers, various vinyls and the like can be used equally well. While printability of the material is desirable, it will also be understood that the sheet material 14 might be solid white and of a translucent nature, or might be dyed, either as a solid color or a marblized, moiree or swirled pattern.

Both to place the sheet material 14 and to retain the sheet material 14, there is a frustoconical sleeve generally designated at 16. The sleeve 16 is preferably transparent, and may be made of polystyrene or other inexpensive material. The upper, or larger diameter of the sleeve which is designated at 18 is sized to receive the pot 10 adjacent to the rim 11, while the lower end, and smaller diameter of the sleeve 16 designated at 19 is designed to receive the lower, or base portion of the pot 10 designated at 13.

Figure 2:
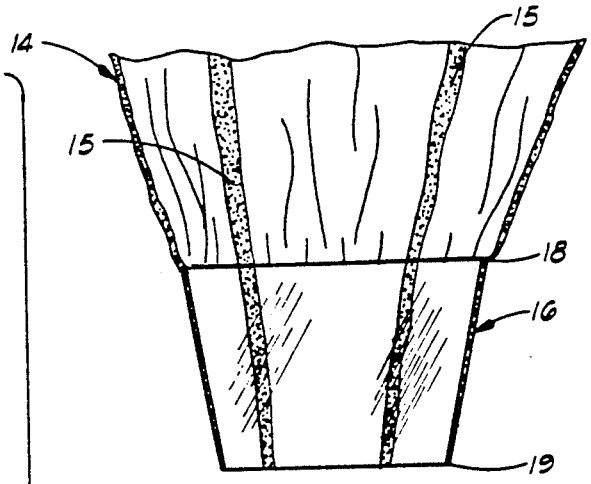
FIG. 2 is an elevational view showing the system of FIG. 1 assembled.
Figure 3:
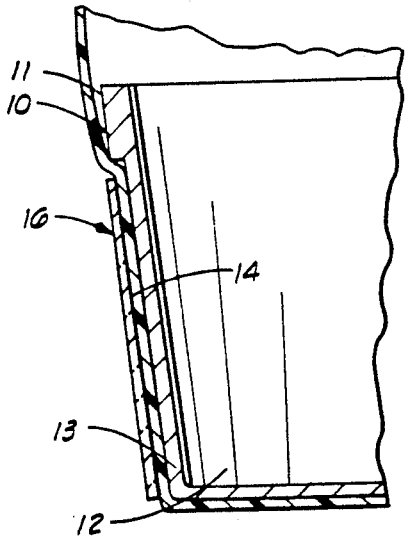
FIG. 3 is a fragmentary, enlarged cross-sectional view taken substantially along a radius of the device shown in FIG. 2 of the drawings.

With the above discussion in mind, attention is directed to FIGS. 2 and 3 of the drawings. While the sheet material 14 is illustrated as substantially circular, it will be readily noted that virtually any other shape of material can also be used, the primary requirement being to have the sheet 14 large enough to cover the pot 10 substantially completely. Any additional material will extend beyond the pot 10 to cover the dirt, plant roots and stems and the like, and is a matter of individual taste and decorating intent. It will therefore be understood that one can select a particular piece of sheet material 14 to comport with the decorating scheme, and the sheet material 14 can be somewhat casually laid across the end 18 of the sleeve 16. The pot 10 can then be placed over the sheet material 14 and dropped into the sleeve 16. Since the sheet material 14 is quite flexible, the sheet material will pleat as necessary and fill the space between the sleeve 16 and the pot 10.

Once the pot 10 has been received completely within the sleeve 16 as shown in FIGS. 2 and 3, the sheet material 14 can be further shaped if desired. By way of example, the material may be pulled upwardly as shown in FIG. 2, or half the material may be pulled up and the other half pulled down to achieve a different appearance. It will be understood, nevertheless, that this "shaping" will be done with little more than the brush of a hand and will not be particularly time consuming.

With the selected sheet material 14 in place over the pot 10 as is illustrated in FIG. 2, it will be realized that a very attractive design has been achieved with a total investment of time of no more than a matter of seconds. By selection of inexpensive materials for the sheet material 14 and the sleeve 16, the entire assembly can be very inexpensive to provide.

Figure 4:
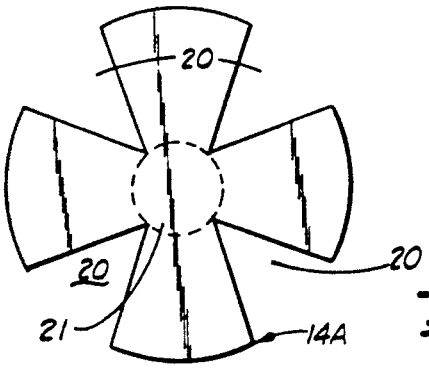
FIG. 4 is a plan view showing an alternate form of sheet material for use with a system as shown it FIG. 1; and, FIG. 5 is a view similar to FIG. 3 but showing a modified form of the invention.

Looking next at FIG. 4 of the drawings, a modified form of sheet material 14 is illustrated, the material in FIG. 4 being designated at 14A.

The sheet material 14A will be somewhat heavier than that discussed in conjunction with FIGS. 1-3, and may be paper, a metalized paper, a heavy plastic material or virtually any other sheet material desired for use as a decoration for the flower pot.

It will be noted that the sheet material 14A defines a plurality of segmental notches 20. Centrally of the sheet material 14A, there is a circle designated at 21 in broken lines, the circle 21 being only by way of illustration to show the size and location of the bottom 13 of the pot 10.

Considering now the sheet material 14A in the assembly shown in FIG. 1, it will be understood that the flower pot 10 will be received on the circle 21 with the sheet material 14A lying over the end 18 of the sleeve 16. With this arrangment, when the pot 10 is lowered into the sleeve 16, the sheet material 14 will fold upwardly; however, rather than requiring the pleating as was discussed in conjunction with FIGS. 1 and 2, the notches 20 provide sufficient relief that the sheet material 14 will not be appreciably pleated. As the pot 10 is covered by the sleeve 16, it will be understood that the sheet material 14 will be urged upardly and the edges of the notches 20 will be substantially contiguous so the entire pot 10 will be covered.

It will therefore be understood by those skilled in the art that a quite different appearance can be achieved on the flower pot 10 since various papers, heavy plastics, metalized papers, or plastics can be utilized, and even a heavy foil can be utilized in the present invention using the configuration shown in FIG. 4 of the drawing. Even though a foil or heavy paper is utilized, the speed of assembly of the plant cover/wrap system renders the system much more economical than the conventional, prior art systems.

Figure 5:
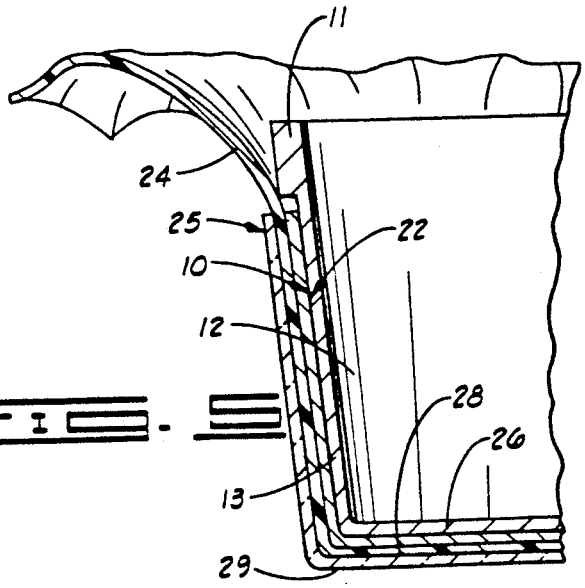

In the systems discussed hereinabove, it is contemplated that the sheet material 14 or 14A will be resistant to moisture. It will be understood, however, that one might occasionally wish to utilize a sheet material that cannot tolerate the moisture that will be present on the outside surface of the flower pot 10. By way of example, one might use painted or printed material on which the colors are not fast, or might utilize very fine fabrics or the like for an exceptionally luxurious appearance. For such an arrangement, the apparatus shown in FIG. 5 will be utilized. In FIG. 5, the pot is again designated at 10 with the rim 11, pot portion 12 and bottom 13. In FIG. 5 it will be seen that there is an inner sleeve 22 covering the pot portion 12 of the flower pot 10. Next to the inner sleeve 22 is the sheet material designated at 24; and, to hold the sheet material 24 in place, there is an outer sleeve 25.

As shown in FIG. 5, it will be seen that the bottom 26 of the flower pot 10 is also covered by a bottom portion 28 of the inner sleeve 22. Thus, the entire pot portion 12 of the flower pot 10 is covered by the inner sleeve 22 to prevent the passage of moisture from the pot 10 to the fabric 24. Similarly, as here shown the sleeve 25 includes a bottom portion 29. It will be obvious to those skilled in the art that the bottom portion 29 can be omitted, but the flower pot would then be resting on the fabric 24. This may not be objectionable since the inner sleeve 22 includes the bottom portion 28 to protect the fabric 24 from moisture.

In using the system shown in FIG. 5 of the drawings, it will be understood that the system will be substantially the same as that discussed above. The outer sleeve 25 will have the sheet material 24 placed thereover. One will then place the flower pot 10 into the inner sleeve 22; and, the covered flower pot can then be set into the outer sleeve 25, allowing the sheet material 24 to be pleated as necessary to fill the space between the inner sleeve 22 and the outer sleeve 25. It will further be understood that a substantially circular piece of sheet material such as the material 14 can be utilized, or a heavier, notched piece of sheet material such as the sheet material 14A can be utilized in the arrangement shown in FIG. 5 of the drawings.

It will therefore be seen that the present invention provides a very quick and easy flower pot cover/wrap system that can be used with inexpensive sheet materials for decoration, and the sheet material can be printed with various designs, or be a solid color, and can even be transparent if such an effect is desired. Through the use of the sleeve 16, installation of the sheet material such as the material 14 will be very quick, taking only a few seconds for complete covering of the pot such as the flower pot 10. Heavy sheet materials can be used by utilizing the arrangement shown in FIG. 4 of the drawings, and delicate fabrics and the like can be utilized by using the inner sleeve 22 in conjunction with the outer sleeve 16 or 25.

It will therefore be understood by those skilled in the art that the particular embodiments of the invention here presented are by way of illustration only, and are meant to be in no way resrictive; therefore, numerous changes and modifications may be made, and the full use of equivalents resorted to, without departing from the spirit or scope of the invention as outlined in the appended claims.

I claim:

1. A method, comprising:

providing a relatively stiff sheet of material;

providing a flower pot having an upper end, a lower end, a bottom and an outer peripheral surface;

providing a sleeve having an upper end with an opening extending therethrough adapted to be received over the flower pot and covering a substantial portion of the outer peripheral surface of the flower pot when received over the flower pot;

cutting segmental notches in said sheet of material;

placing the sheet of material over the upper end of the sleeve;

placing the flower pot generally over the upper end of the sleeve and generally over the sheet of material; and lowering the flower pot into the opening in the sleeve until the flower pot is placed generally within the opening in the sleeve with the sleeve covering a substantial portion of the outer peripheral surface of the flower pot and with the sheet of material substantially covering the outer peripheral surface of the flower pot and being disposed generally between the sleeve and the outer peripheral surface of the flower pot with a portion of the sheet of material extending beyond the upper end of the sleeve and outwardly from the upper end of the flower pot, the sleeve engaging the sheet of material and holding the sheet of material against the outer peripheral surface of the flower pot and providing a decorative cover for the flower pot, the sleeve engaging and holding the sheet of material against the outer peripheral surface of the flower pot and providing the sole means for holding the sheet of material in position about the outer peripheral surface of the flower pot.

2. A method, comprising:

providing a sheet of material;

providing a flower pot having an upper end, a lower end, a bottom and an outer peripheral surface;

providing an outer sleeve having an upper end with an opening extending therethrough adapted to be received over the flower pot and covering a substantial portion of the outer peripheral surface of the flower pot when received over the flower pot;

providing an inner sleeve having an upper end with an opening extending therethrough adapted to be received over the flower pot and covering a substantial portion of the outer peripheral surface of the flower pot when received over the flower pot;

placing the inner sleeve about the outer peripheral surface of the flower pot whereby the inner sleeve covers a substantial portion of the outer peripheral surface of the flower pot and the flower pot is disposed in the opening in the inner sleeve;

placing the sheet of material over the opening in the outer sleeve;

placing the flower pot with the inner sleeve disposed thereon generally over the opening in the outer sleeve; and lowering the flower pot with the inner sleeve placed thereon into the opening in the outer sleeve until the flower pot is disposed generally within the opening in the outer sleeve and the outer sleeve covers a substantial portion of the outer peripheral surface of the flower pot and the outer sleeve covers a substantial portion of the inner sleeve with the sheet of material being disposed generally between the outer sleeve and the inner sleeve, the sleeve engaging and holding the sheet of material against the inner sleeve and providing the sole means for holding the sheet of material in position about the inner sleeve.

3. The method of claim 2 wherein the inner sleeve includes a lower end substantially covering the bottom of the flower pot when the inner sleeve is placed on the flower pot.

4. The method of claim 3 wherein the sleeve is defined further as having a lower end substantially covering the bottom of the flower pot and the inner sleeve placed thereon when the flower pot with the inner sleeve placed thereon is placed in the sleeve.

5. The method of claim 2 wherein the sleeve is defined further as being transparent whereby the sheet of material is visible through the sleeve.

* * * * *

UNITED STATES PATENT AND TRADEMARK OFFICE
CERTIFICATE OF CORRECTION

PATENT NO. : 5,085,003

DATED : February 4, 1992

INVENTOR(S) : Pedro F. Garcia

It is certified that error appears in the above-identified patent and that said Letters Patent is hereby corrected as shown below:

On the title page, Item [21] Appl. No.: "434,584" should be changed to --434,581--.

Column 3, line 39, the word "upardly" should be changed to --upwardly--.

Column 4, line 44, the word "resrictive" should be changed to --restrictive--.

Signed and Sealed this
Eighth Day of June, 1993

*Attest:*

*Attesting Officer*

Michael K. Kirk

MICHAEL K. KIRK

*Acting Commissioner of Patents and Trademarks*